US007456558B2

(12) United States Patent
Bühler et al.

(10) Patent No.: US 7,456,558 B2
(45) Date of Patent: Nov. 25, 2008

(54) ELECTRIC INCANDESCENT LAMP PROVIDED WITH DIFFERENT PITCH FACTORS FOR EACH END OF A FILAMENT COMPONENT

(75) Inventors: Manfred Bühler, Herbrechtingen (DE); Klaus Wittmann, Sontheim (DE)

(73) Assignee: Patent-Treuhand-Gesellschaft für elektrische Glühlampen mbH, Munich (DE)

( * ) Notice: Subject to any disclaimer, the term of this patent is extended or adjusted under 35 U.S.C. 154(b) by 459 days.

(21) Appl. No.: 11/194,588

(22) Filed: Aug. 2, 2005

(65) Prior Publication Data

US 2006/0038489 A1 Feb. 23, 2006

(30) Foreign Application Priority Data

Aug. 19, 2004 (DE) ..... 10 2004 040 415

(51) Int. Cl.
*H01K 1/02* (2006.01)
*H01K 1/14* (2006.01)

(52) U.S. Cl. ..... 313/315; 313/341; 313/344; 313/578

(58) Field of Classification Search ..... 313/351, 313/316, 271–273
See application file for complete search history.

(56) References Cited

U.S. PATENT DOCUMENTS 4,413,204 A * 11/1983 Byszewski et al. ..... 313/491
6,465,949 B1 * 10/2002 Miahara et al. ..... 313/493
6,600,255 B1 * 7/2003 Kai et al. ..... 313/271
6,777,860 B2 * 8/2004 Franck ..... 313/344
2006/0038471 A1 * 2/2006 Buhler et al. ..... 313/271

FOREIGN PATENT DOCUMENTS

| | | | |
|---|---|---|---|
| DE | 24 01 541 | A1 | 8/1974 |
| DE | 243 141 | A1 | 2/1984 |
| DE | 243 141 | | 2/1987 |
| EP | 0 123 844 | A2 | 11/1984 |
| EP | 1 102 309 | A1 | 5/2001 |
| EP | 1 104 010 | A1 | 5/2001 |

OTHER PUBLICATIONS

Anonymous "Differential Pitch Helix Coil for Copier Lamp" Research Disclosure, Mason Publications, Hampshire, GB Mar. 14, 1989.

* cited by examiner

*Primary Examiner*—Mariceli Santiago
(74) *Attorney, Agent, or Firm*—William E. Meyer

(57) ABSTRACT

The invention relates to an electric incandescent lamp, in particular a vehicle headlight, having at least one incandescent filament which is arranged within a light-permeable lamp vessel, the at least one incandescent filament having different pitch factors at its two ends. In order to increase the luminance at the light/dark boundary of the lower beam, that end of the incandescent filament which is near to the base has a lower pitch factor.

2 Claims, 4 Drawing Sheets

Figure 1:
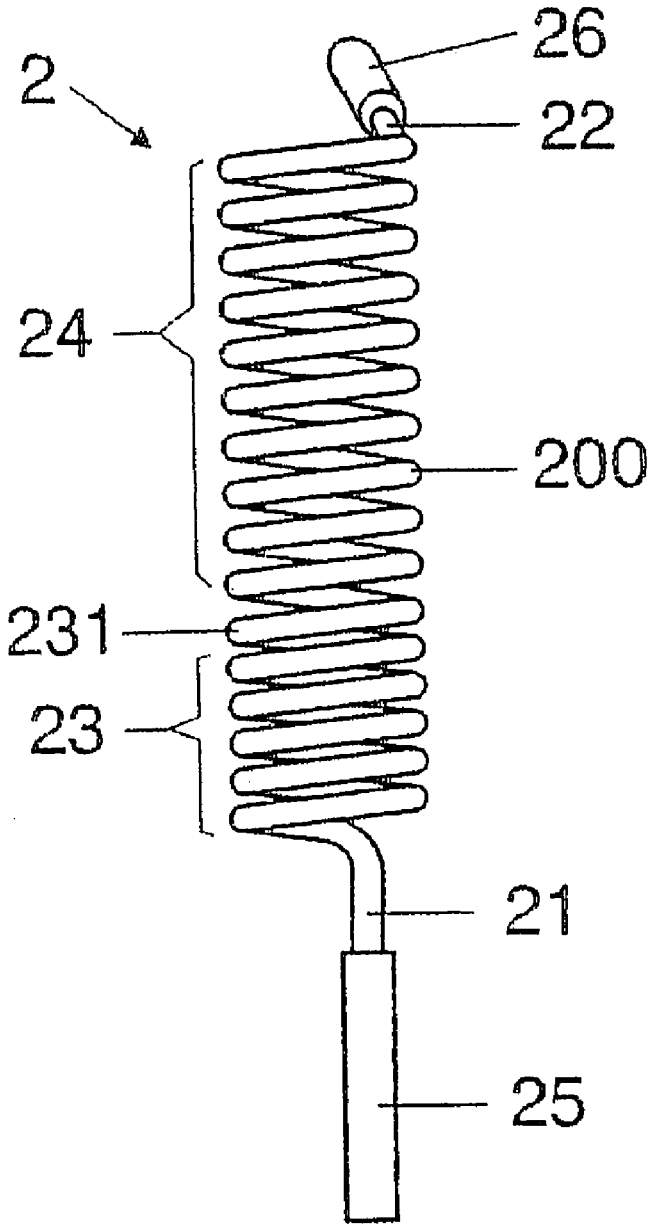

ELECTRIC INCANDESCENT LAMP PROVIDED WITH DIFFERENT PITCH FACTORS FOR EACH END OF A FILAMENT COMPONENT

I. TECHNICAL FIELD

The invention relates to an electric incandescent lamp having at least one incandescent filament which is arranged within a light-permeable lamp vessel, the at least one incandescent filament having a different pitch.

II. BACKGROUND ART

Such an electric incandescent lamp has been disclosed, for example, in German patent specification DD 243 141 A1. This specification describes a linear electric incandescent lamp having an incandescent filament, whose pitch or pitch factor diminishes continuously or abruptly from the center of the incandescent filament in the direction of the two incandescent filament ends. The pitch is defined as the sum of the filament wire diameter and the interspace between two adjacent turns of the incandescent filament. The pitch factor is defined as the quotient of the pitch and the filament wire diameter.

III. DISCLOSURE OF THE INVENTION

It is the object of the invention to provide an electric incandescent lamp which can be used in a vehicle headlight for the purpose of producing the lower beam and ensures greater luminance than conventional headlamps for the imaging in headlights in the region of the light/dark boundary.

This object is achieved according to the invention by an electric incandescent lamp having at least one incandescent filament which is arranged within a light-permeable lamp vessel, the at least one incandescent filament having a different pitch, wherein the at least one incandescent filament has, at its first end, a first pitch factor and, at its second end, a second pitch factor, the first pitch factor being less than the second pitch factor. Particularly advantageous embodiments of the invention are described in the dependent patent claims.

The electric incandescent lamp according to the invention has at least one incandescent filament which is arranged within a light-transmissive lamp vessel and has, at its first end, a first pitch factor and, at its second end, a second pitch factor, the first pitch factor being less than the second pitch factor.

Owing to the lesser pitch factor, the at least one incandescent filament has a higher luminance at its first end than at its second end. The incandescent lamp according to the invention is therefore particularly well suited for projection applications, for example as a light source in a vehicle headlight. The light emitted by the first filament end can advantageously be used in this application for the purpose of producing a sharp light/dark boundary of the lower beam by it being projected into the far field in front of the headlight and the light emitted by the second filament section being projected into the near field of the headlight, directly in front of the vehicle. This makes it possible for a high luminance to be achieved in the region of the light/dark boundary of the lower beam, where good illumination is desired.

The incandescent lamp according to the invention is advantageously in the form of an incandescent lamp having a base at one end, i.e. one end of its lamp vessel is provided with a base, the first end of the at least one incandescent filament facing that end of the lamp vessel which is provided with the base. In vehicle headlights, lamps having a base at one end are generally used which are mounted in the headlight reflector via a rear-side opening such that the base is fixed in a mount in the rear-side opening. Owing to this orientation of the lamp, the light which is generated by that end of the incandescent filament which is near to the base is projected into the region of the light/dark boundary or the far field of the headlight. That end of the incandescent filament which is near to the base is therefore preferably formed by the first filament end having the lesser pitch factor for the purpose of achieving the abovementioned advantages. In accordance with the preferred exemplary embodiments of the invention, the at least one incandescent filament is aligned axially, i.e. the filament axis of the at least one incandescent filament extends parallel to the longitudinal extent of the lamp vessel or the incandescent lamp and, in the case of an axially symmetrical lamp vessel, parallel to the longitudinal axis, or even lies on the longitudinal axis of the lamp vessel.

In accordance with the preferred exemplary embodiments of the invention, a first filament section having the first pitch factor is arranged at the first incandescent filament end, and a second filament section having the second pitch factor is arranged at its second end. In order to prevent overheating of the incandescent filament in its central filament section and a resultant shortening of its life, the second filament section has a greater number of turns than the first filament section. The turns ratio of the first and the second filament section is preferably less than or equal to 0.5 in order to ensure that the second filament section extends at least up to the center of the filament.

The second pitch factor of the at least one incandescent filament of the incandescent lamp according to the invention is preferably less than or equal to 1.8 for manufacturing-related reasons, and its first pitch factor is preferably greater than 1.3. At a pitch factor of greater than 1.8 there would be the risk of the incandescent filaments hooking into the incandescent filament supply device at their ends having the greater pitch factor and of no longer being capable of being disentangled. At pitch factors of 1.3 or less, electrical short circuits could occur between adjacent turns of the incandescent filament. A pitch factor of 1.5 is therefore preferred for the first, more tightly wound filament section.

IV. BRIEF DESCRIPTION OF THE DRAWINGS

Figure 2:
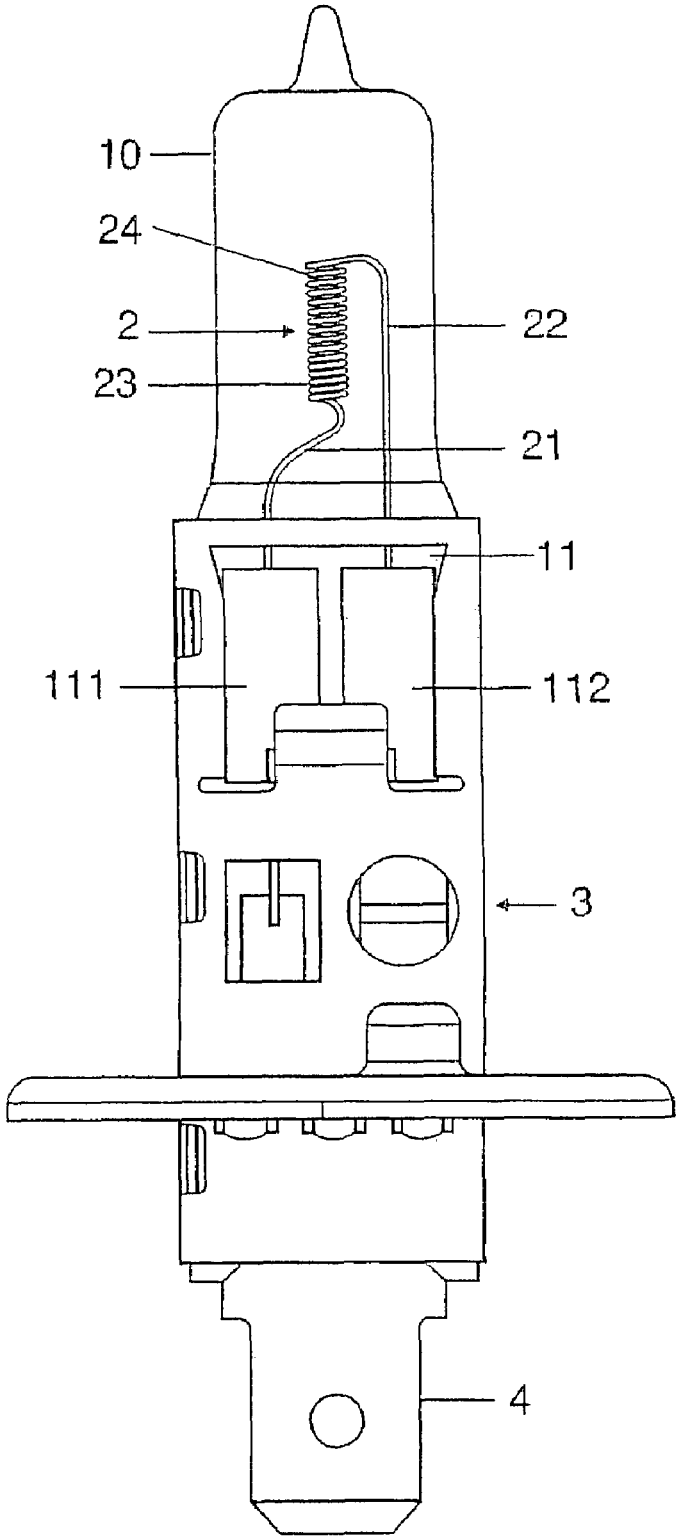
Figure 3:
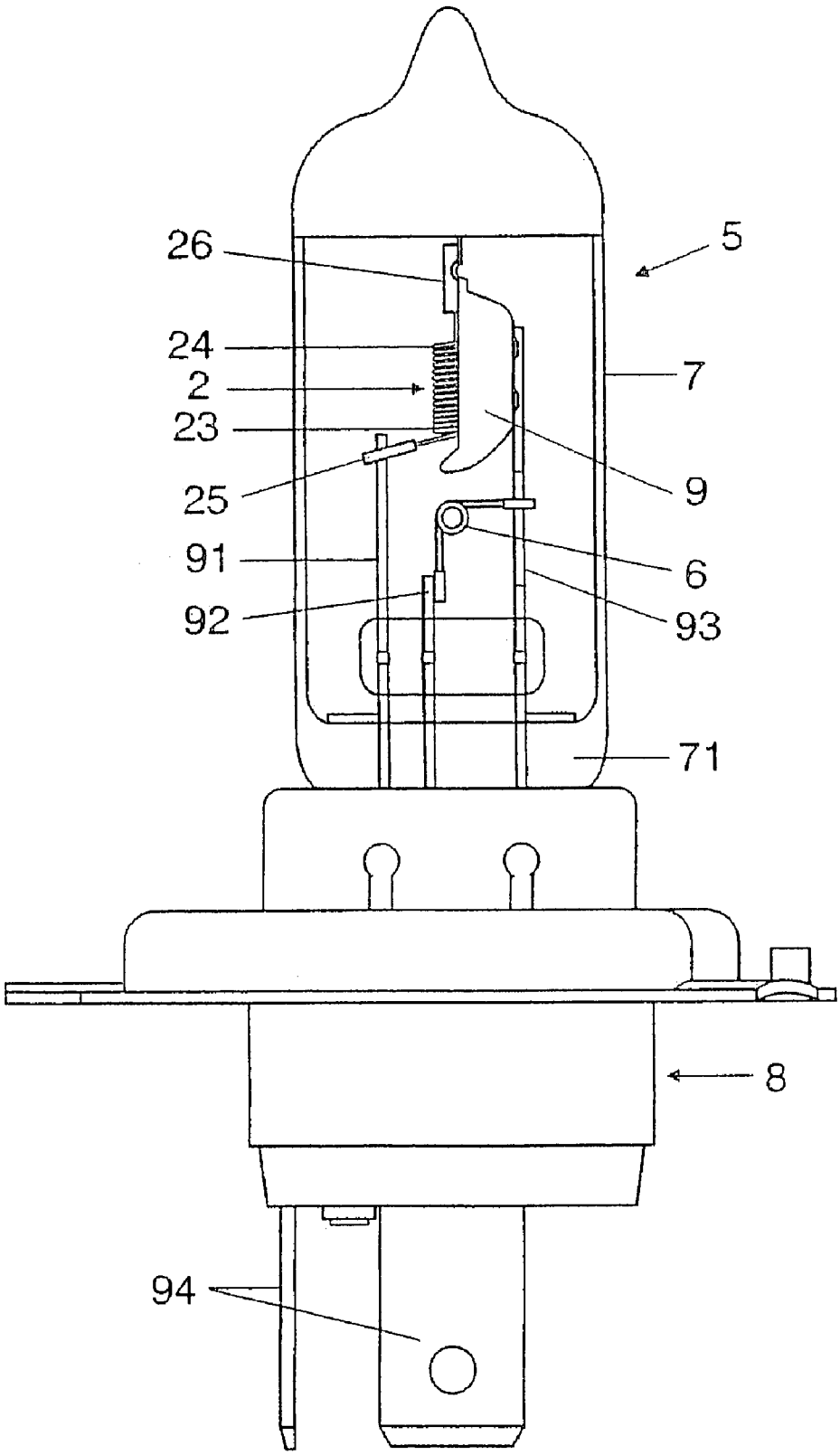
Figure 4:
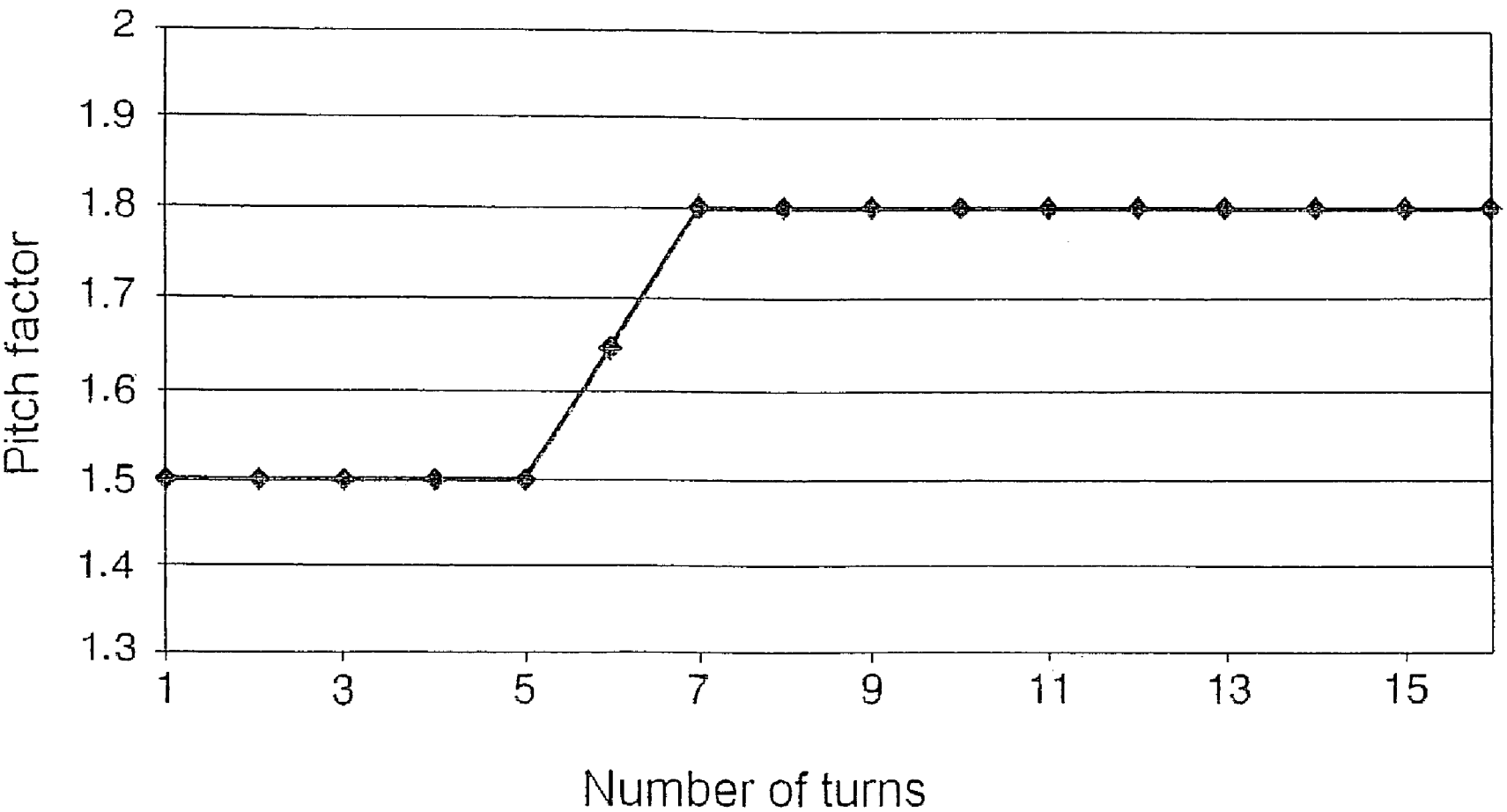

The invention will be explained in more detail below with reference to several preferred exemplary embodiments. In the drawing:

FIG. 1 shows a schematic illustration of a side view of an incandescent filament in accordance with the preferred exemplary embodiment of the invention, FIG. 2 shows a schematic illustration of a side view of a vehicle headlamp in accordance with the first exemplary embodiment of the invention, FIG. 3 shows a schematic illustration of a side view of a vehicle headlamp in accordance with the second exemplary embodiment of the invention, and FIG. 4 shows an illustration of the pitch factors of the incandescent filament depicted in FIG. 1.

V. BEST MODE FOR CARRYING OUT THE INVENTION

FIG. 2 is a schematic illustration of a halogen incandescent lamp for a vehicle headlight in accordance with the first exemplary embodiment of the invention. This halogen incandescent lamp 1 has an electrical power consumption of 55 watts and a rated voltage of 12 volts and serves the purpose of producing the lower beam in a motor vehicle headlight. The halogen incandescent lamp 1 has a lamp vessel 10 made from quartz glass having a sealed end 11 which is provided with a metallic base 3. An incandescent filament 2 made from a single-coiled tungsten wire 200 is arranged within the lamp vessel 10. The incandescent filament 2 is aligned axially within the lamp vessel 10, i.e. parallel to the longitudinal axis of the lamp vessel 10, or lies on the longitudinal axis of the lamp vessel 10. The two uncoiled outgoing filament sections 21, 22 of the incandescent filament 2 are each connected to a current supply wire, which protrudes from the lamp vessel 10 and is electrically conductively connected to the contact lug 4 or to the base shell 3, by means of a molybdenum foil 111, 112 embedded in a gas-tight manner in the sealed end 11 of the lamp vessel 10. The outgoing filament sections 21, 22 are each surrounded by a molybdenum tube 25, 26 for the purpose of mounting the incandescent filament 2 in the two-filament halogen incandescent lamp 5 shown in FIG. 3, said molybdenum tubes 25, 26 being used for welding them to the power supply wire and the anti-dazzle device, respectively. In the halogen incandescent lamp 1 depicted in FIG. 2, the molybdenum tubes 25, 26 are dispensed with since the outgoing filament sections 21, 22 in this case can be welded directly to the molybdenum foils 111, 112.

The incandescent filament 2 is illustrated schematically in FIG. 1. It has a first filament section 23 having a pitch factor of 1.5 which extends over five turns of the incandescent filament 2, and a second filament section 24 having a pitch factor of 1.8 which extends over ten turns. The first, more tightly wound filament section 23 faces the sealed end 11 and the base 3. The two filament sections 23 and 24 are connected to one another by means of a transition section 231 which comprises only one, namely the sixth, turn. FIG. 4 shows the pitch factors of the sixteen turns of the incandescent filament 2. The diameter or the thickness of the tungsten wire 200 of the incandescent filament 2 is 155.2 micrometers. The external diameter of the turns of the incandescent filament 2 is 1.24 millimeters ±0.01 millimeters. The pitch factor of the filament sections 23, 24 is calculated as the quotient of the pitch of the turns of the respective filament section 23 or 24 and the thickness of the incandescent filament wire 200. The length of the incandescent filament 2, without taking into account the outgoing filament sections 21, 22, is 4.33 millimeters.

FIG. 3 shows a schematic illustration of a halogen incandescent lamp for a vehicle headlight in accordance with the second exemplary embodiment of the invention. This halogen incandescent lamp is a two-filament halogen incandescent lamp 5 having two incandescent filaments 2, 6 which serve the purpose of producing the lower beam and the upper beam for the vehicle. This halogen incandescent lamp 5 is envisaged for operation at a vehicle power supply system rated voltage of 12 volts. It has a vitreous lamp vessel 7 having a sealed end 71 which is provided with a metallic base 8. A first incandescent filament 6 for producing the upper beam and a second incandescent filament 2 for producing the lower beam of the vehicle are arranged within the lamp vessel 7. The incandescent filament 2 has the above-described properties and is therefore provided with the same reference as in FIGS. 1, 2 and 3. The incandescent filament 2 is aligned axially in the lamp vessel 7 such that its first section 23 faces the sealed end 71 and the base 8, and it is also partially surrounded by an anti-dazzle device 9. The two incandescent filaments 2, 6 are borne and supplied with electrical energy by three current supply wires 91, 92, 93 which are passed out through the sealed end 71 of the lamp vessel 7 and are connected to in each case one of the three electrical connections 94 of the lamp 5. The first outgoing filament section 21, which is enveloped by the molybdenum tube 25, of the incandescent filament 2 is welded to the current supply wire 91, and the second outgoing filament section 22, which is enveloped by the molybdenum tube 26, of the incandescent filament 2 is welded to the anti-dazzle device 9.

The invention is not restricted to the exemplary embodiments explained in more detail above. For example, the thickness of the filament wire 200 may be reduced, and the number of turns of the filament sections 23 and 24 of the incandescent filament 2 may be increased in order to match the incandescent filament 2 to a higher vehicle power supply system voltage than 12 volts, for example a vehicle power supply system rated voltage of 24 volts. The invention is particularly suitable for lamps having axially aligned incandescent filaments, such as H1, H7, H8, H9, H11, HB3, HB4 lamps and H4 lamps as well as H13 lamps. In order to increase the luminance at the light/dark boundary further still, the incandescent filament 2 may also be conical such that the external diameter of its turns is continuously reduced starting from the last turn to the first turn.

What is claimed is:

1. An electric incandescent lamp having at least one incandescent filament which is arranged within a light-transmissive lamp vessel, the at least one incandescent filament having a different pitch, wherein said at least one incandescent filament has, at its first end, a first pitch factor and, at its second end, a second pitch factor, the first pitch factor being less than the second pitch factor;

wherein a first filament section having said first pitch factor is arranged at said first end of the at least one incandescent filament, and a second filament section having said second pitch factor is arranged at its said second end; and wherein the number of turns in said second filament section is greater than the number of turns in said first filament section.

2. The electric incandescent lamp as claimed in claim 1, wherein the turns ratio of the first and the second filament section is less than or equal to 0.5.

* * * * *